US009361906B2

(12) United States Patent
Roberts

(10) Patent No.: US 9,361,906 B2
(45) Date of Patent: Jun. 7, 2016

(54) METHOD OF TREATING AN AUDITORY DISORDER OF A USER BY ADDING A COMPENSATION DELAY TO INPUT SOUND

(71) Applicant: R2 WELLNESS, LLC, Villa Park, CA (US)

(72) Inventor: Roger Roberts, Villa Park, CA (US)

(73) Assignee: R2 WELLNESS, LLC, Villa Park, CA (US)

( * ) Notice: Subject to any disclaimer, the term of this patent is extended or adjusted under 35 U.S.C. 154(b) by 0 days.

(21) Appl. No.: 14/582,871

(22) Filed: Dec. 24, 2014

(65) Prior Publication Data

US 2015/0120310 A1 Apr. 30, 2015

Related U.S. Application Data

(63) Continuation of application No. 13/544,073, filed on Jul. 9, 2012, now abandoned.

(60) Provisional application No. 61/505,920, filed on Jul. 8, 2011.

(51) Int. Cl.

| | |
|---|---|
| ***G10L 19/00*** | (2013.01) |
| ***G10L 25/00*** | (2013.01) |
| ***G10L 21/057*** | (2013.01) |
| ***G10L 21/02*** | (2013.01) |
| ***G10L 21/043*** | (2013.01) |
| ***G10L 25/48*** | (2013.01) |
| *G10L 21/0316* | (2013.01) |

(Continued)

(52) U.S. Cl.

CPC ..... *G10L 21/057* (2013.01); *G10L 21/02* (2013.01); *G10L 21/043* (2013.01); *G10L 25/48* (2013.01); *H04R 25/70* (2013.01); *G10L 21/0316* (2013.01); *H04R 1/1008* (2013.01); *H04R 1/1091* (2013.01); *H04R 25/04* (2013.01); *H04R 25/552* (2013.01); *H04R 25/554* (2013.01); *H04R 2225/41* (2013.01); *H04R 2225/61* (2013.01); *H04R 2420/07* (2013.01)

(58) Field of Classification Search

USPC ..... 704/215, 271, 503

See application file for complete search history.

(56) References Cited

U.S. PATENT DOCUMENTS 5,056,398 A 10/1991 Adamson
5,131,047 A 7/1992 Hashimoto et al.

(Continued)

OTHER PUBLICATIONS

Ben-Sasson et al.; Sensory over-responsivity in elementary school: prevalence and social-emotional correlates; J Abnorm Child Psychol.; 37(5):705-16; Jul 2009; total 16 pages.

(Continued)

*Primary Examiner* — Jesse Pullias
(74) *Attorney, Agent, or Firm* — Shey Glenn LLP

(57) ABSTRACT

An audio input device is provided which can include a number of features. In some embodiments, the audio input device includes a housing, a microphone carried by the housing, and a processor carried by the housing and configured to modify an input sound signal so as to amplify frequencies corresponding to a target human voice and diminish frequencies not corresponding to the target human voice. In another embodiment, an audio input device is configured to treat an auditory gap condition of a user by extending gaps in continuous speech and outputting the modified speech to the user. In another embodiment, the audio input device is configured to treat a dichotic hearing condition of a user. Methods of use are also described.

10 Claims, 8 Drawing Sheets

(51) Int. Cl.

| | |
|---|---|
| *H04R 1/10* | (2006.01) |
| *H04R 25/04* | (2006.01) |
| *H04R 25/00* | (2006.01) |

(56) References Cited

U.S. PATENT DOCUMENTS

| | | | |
|---|---|---|---|
| 5,208,867 | A | 5/1993 | Stites, III |
| 5,572,593 | A | 11/1996 | Nejime et al. |
| 5,740,258 | A | 4/1998 | Goodwin-Johansson |
| 6,684,063 | B2 | 1/2004 | Berger et al. |
| 7,016,512 | B1 | 3/2006 | Feeley et al. |
| 7,171,357 | B2 | 1/2007 | Boland |
| 7,412,376 | B2 | 8/2008 | Florencio et al. |
| 7,444,280 | B2 | 10/2008 | Vandali et al. |
| 8,189,839 | B2 | 5/2012 | Lenhardt et al. |
| 8,210,851 | B2 | 7/2012 | Wade et al. |
| 8,374,877 | B2 | 2/2013 | Fusakawa et al. |
| 2005/0114127 | A1 | 5/2005 | Rankovic |
| 2006/0177799 | A9 | 8/2006 | Stuart et al. |
| 2007/0049788 | A1 | 3/2007 | Kalinowski et al. |
| 2008/0240481 | A1 | 10/2008 | Widmer et al. |
| 2008/0258871 | A1 | 10/2008 | Waldmann |
| 2008/0279395 | A1 | 11/2008 | Hersbach et al. |
| 2008/0300703 | A1 | 12/2008 | Widmer et al. |
| 2008/0301944 | A1 | 12/2008 | Widmer et al. |
| 2009/0010463 | A1 | 1/2009 | Boretzki et al. |
| 2009/0018465 | A1 | 1/2009 | Hessel et al. |
| 2009/0028364 | A1 | 1/2009 | Vonlanthen |
| 2009/0064852 | A1 | 3/2009 | Glatt |
| 2009/0076825 | A1 | 3/2009 | Bradford et al. |
| 2009/0097680 | A1 | 4/2009 | Drtina |
| 2009/0112224 | A1 | 4/2009 | Bachler et al. |
| 2009/0123009 | A1 | 5/2009 | Roeck et al. |
| 2009/0196449 | A1 | 8/2009 | Platz |
| 2009/0197562 | A1 | 8/2009 | Platz |
| 2009/0226015 | A1 | 9/2009 | Zeng et al. |
| 2009/0262948 | A1 | 10/2009 | Hasler et al. |
| 2009/0268933 | A1 | 10/2009 | Baechler |
| 2009/0285424 | A1 | 11/2009 | Boretzki et al. |
| 2009/0320273 | A1 | 12/2009 | Haussmann |
| 2010/0002886 | A1 | 1/2010 | Doclo et al. |
| 2010/0002887 | A1 | 1/2010 | Roeck et al. |
| 2010/0014696 | A1 | 1/2010 | Boschung et al. |
| 2010/0020989 | A1 | 1/2010 | Waldmann |
| 2010/0032267 | A1 | 2/2010 | Gabathuler et al. |
| 2010/0034405 | A1 | 2/2010 | Roeck et al. |
| 2010/0067711 | A1 | 3/2010 | Waldmann |
| 2010/0067713 | A1 | 3/2010 | Boschung et al. |
| 2010/0080398 | A1 | 4/2010 | Waldmann |
| 2010/0086159 | A1 | 4/2010 | Gabathuler et al. |
| 2010/0092017 | A1 | 4/2010 | Waldmann |
| 2010/0092018 | A1 | 4/2010 | Allegro-Baumann et al. |
| 2010/0104122 | A1 | 4/2010 | Waldmann |
| 2010/0119077 | A1 | 5/2010 | Platz et al. |
| 2010/0128906 | A1 | 5/2010 | Haenggi et al. |
| 2010/0128907 | A1 | 5/2010 | Dijkstra et al. |
| 2010/0128915 | A1 | 5/2010 | Vonlanthen et al. |
| 2010/0135500 | A1 | 6/2010 | Derleth et al. |
| 2010/0135512 | A1 | 6/2010 | Haenggi et al. |
| 2010/0142736 | A1 | 6/2010 | Aquilina |
| 2010/0142737 | A1 | 6/2010 | Roeck et al. |
| 2010/0150384 | A1 | 6/2010 | Waldmann |
| 2010/0150387 | A1 | 6/2010 | Dijkstra et al. |
| 2010/0150388 | A1 | 6/2010 | Korl |
| 2010/0172525 | A1 | 7/2010 | Angst et al. |
| 2010/0172526 | A1 | 7/2010 | Platz et al. |
| 2010/0183161 | A1 | 7/2010 | Boretzki |
| 2010/0183172 | A1 | 7/2010 | Roeck |
| 2010/0183176 | A1 | 7/2010 | Schwarz |
| 2010/0195836 | A1 | 8/2010 | Platz |
| 2010/0202625 | A1 | 8/2010 | Boretzki et al. |
| 2010/0202637 | A1 | 8/2010 | Cornelisse et al. |
| 2010/0202638 | A1 | 8/2010 | Roeck |
| 2010/0202644 | A1 | 8/2010 | Angst et al. |
| 2010/0202648 | A1 | 8/2010 | Dittli et al. |
| 2010/0205447 | A1 | 8/2010 | Waldmann |
| 2010/0208906 | A1 | 8/2010 | Vonlanthen |
| 2010/0208922 | A1 | 8/2010 | Erni et al. |
| 2010/0220879 | A1 | 9/2010 | Feilner et al. |
| 2010/0220884 | A1 | 9/2010 | Aquilina et al. |
| 2010/0239111 | A1 | 9/2010 | Karamuk et al. |
| 2010/0260363 | A1 | 10/2010 | Glatt et al. |
| 2010/0260367 | A1 | 10/2010 | Hasler et al. |
| 2010/0266151 | A1 | 10/2010 | Glatt et al. |
| 2010/0272297 | A1 | 10/2010 | Boretzki |
| 2010/0272298 | A1 | 10/2010 | Feilner et al. |
| 2010/0278356 | A1 | 11/2010 | Hersbach et al. |
| 2010/0278365 | A1 | 11/2010 | Biundo Lotito et al. |
| 2010/0278366 | A1 | 11/2010 | Biundo Lotito et al. |
| 2010/0293227 | A1 | 11/2010 | Hasler et al. |
| 2010/0296680 | A1 | 11/2010 | Korl et al. |
| 2010/0303269 | A1 | 12/2010 | Baechler |
| 2010/0310103 | A1 | 12/2010 | Baechler et al. |
| 2010/0319189 | A1 | 12/2010 | Karamuk |
| 2010/0322448 | A1 | 12/2010 | Waldmann |
| 2010/0329492 | A1 | 12/2010 | Derleth et al. |
| 2011/0007916 | A1 | 1/2011 | Chapero-Rueda et al. |
| 2011/0007919 | A1 | 1/2011 | Aquilina et al. |
| 2011/0015466 | A1 | 1/2011 | Waldmann |
| 2011/0026746 | A1 | 2/2011 | Baechler et al. |
| 2011/0026747 | A1 | 2/2011 | Ochsenbein et al. |
| 2011/0044481 | A1 | 2/2011 | Marquis et al. |
| 2011/0058698 | A1 | 3/2011 | Buhmann et al. |
| 2011/0091060 | A1 | 4/2011 | von Dombrowski et al. |
| 2011/0091061 | A1 | 4/2011 | von Dombrowski et al. |
| 2011/0103610 | A1 | 5/2011 | Harsch |
| 2011/0103628 | A1 | 5/2011 | Baechler |
| 2011/0106508 | A1 | 5/2011 | Boretzki |
| 2011/0116668 | A1 | 5/2011 | Karamuk et al. |
| 2011/0129106 | A1 | 6/2011 | Hasler et al. |
| 2011/0142272 | A1* | 6/2011 | Takagi ..... A61B 5/121 381/321 |
| 2011/0150256 | A1 | 6/2011 | Baechler et al. |
| 2011/0158444 | A1 | 6/2011 | Waldmann |
| 2011/0188681 | A1 | 8/2011 | Kramer et al. |
| 2011/0188682 | A1 | 8/2011 | Menzl et al. |
| 2011/0188683 | A1 | 8/2011 | Harsch et al. |
| 2011/0188684 | A1 | 8/2011 | Spieler et al. |
| 2011/0243355 | A1 | 10/2011 | Schmitt et al. |
| 2011/0243357 | A1 | 10/2011 | Probst et al. |
| 2011/0243358 | A1 | 10/2011 | Platz et al. |
| 2011/0258839 | A1 | 10/2011 | Probst |
| 2011/0274284 | A1 | 11/2011 | Mülder et al. |
| 2011/0280426 | A1 | 11/2011 | Baechler |
| 2011/0286608 | A1 | 11/2011 | Hautier et al. |
| 2011/0299693 | A1 | 12/2011 | Cherigui |
| 2012/0057735 | A1 | 3/2012 | Meier et al. |
| 2012/0063622 | A1 | 3/2012 | Bruckhoff et al. |
| 2012/0099748 | A1 | 4/2012 | Probst et al. |
| 2012/0114158 | A1 | 5/2012 | Gysin |
| 2012/0140962 | A1 | 6/2012 | Ubezio et al. |
| 2012/0140967 | A1 | 6/2012 | Aubert |
| 2012/0148079 | A1 | 6/2012 | Gabathuler et al. |
| 2012/0163642 | A1 | 6/2012 | Dittli et al. |
| 2013/0013302 | A1 | 1/2013 | Roberts |

OTHER PUBLICATIONS

Brett-Green et al.; An exploratory event-related potential study of multisensory integration in sensory over-responsive children; Brain Res.; 1321:67-77; Mar 19, 2010; total 11 pages.

* cited by examiner

METHOD OF TREATING AN AUDITORY DISORDER OF A USER BY ADDING A COMPENSATION DELAY TO INPUT SOUND

CROSS REFERENCE TO RELATED APPLICATIONS

This application is a continuation of U.S. application Ser. No. 13/544,073, filed Jul. 9, 2012, which claims the benefit under 35 U.S.C. 119 of U.S. Provisional Application No. 61/505,920, filed Jul. 8, 2011, titled "Auditory Input De-Intensifying Device," all of which are incorporated herein by reference in their entirety.

INCORPORATION BY REFERENCE

All publications and patent applications mentioned in this specification are herein incorporated by reference to the same extent as if each individual publication or patent application was specifically and individually indicated to be incorporated by reference.

FIELD OF THE DISCLOSURE

The present disclosure pertains to audio input devices, auditory input de-intensifying systems, and methods of modifying sound.

BACKGROUND OF THE DISCLOSURE

Sounds are all around us. Sometimes the sounds may be music or a friend's voice that an individual wants to hear. Other times, sound may be noise from a vehicle, an electronic device, a person talking, an airline engine, or a rustling paper and can be overwhelming, unpleasant or distracting. A person at work, on a bus, or on an airline jet may want to reduce the noise around them. Various approaches have been developed to help people manage background noise in their environment. For example, noise cancelling headsets can cancel or reduce background noise using an interfering sound wave.

While unwanted sounds can be distracting to anyone, they are especially problematic for a group of people who have Auditory Processing Disorder (APD). Auditory Processing Disorder (APD) is thought to involve disorganization in the way that the body's neurological system processes and comprehends words and sounds received from the environment. With APD, the brain does not receive or process information correctly; this can cause adverse reactions in people with this disorder. APD can exist independently of other conditions, or can be co-morbid with other neurological and psychological disorders, especially Autism Spectrum Disorders. It is estimated that between 2 and 5 percent of the population has some type of Auditory Processing Disorder.

When an individual's hearing or perception of hearing is affected, Auditory Sensory Over-Responsivity (ASOR) or Auditory Processing Disorder (APD) may be the cause. For example, school can be a very uncomfortable environment for a child with Auditory Sensory ASOR, as extraneous noises can be distracting and painful. A child may have difficulty understanding and following directions from a teacher. A child with APD or ASOR can experience frustration and learning delays as a result. The child may not be able to focus on classroom instruction when their auditory system is unable to ignore the extra stimuli. When these children experience this type of discomfort, negative externalizing behaviors can also escalate.

Some individuals with APD have problems detecting short gaps (or silence) in continuous speech flow. The ability for a listener to detect these gaps, even if very short, is critical to improve the intelligibility of normal conversation, since a listener with an inability to detect gaps in continuous speech can have difficulty distinguishing between words and comprehending spoken language. It is generally accepted that normal individuals can detect gaps as short as about 7 ms. However, patients with APD may be unable to detect gaps under 20 ms or more. As a result, these individuals can perceive conversation as a continuous, non-cadenced flow that is difficult to understand.

Other people with APD can have dichotic disorders that affect how one or both of the ears process sound relative to the other. In some patients where a sound is received by both ears, one ear may "hear" the sound normally, and the other ear may "hear" the sound with an added delay or different pitch/frequency than the first ear. For example, when one ear hears a sound with a slight delay and the other ear hears the sound normally, the patient can become confused due to the way the differing sounds are processed by the brain.

Additionally, some individuals with ASOR can have a condition called hyperacusis or misophonia which occurs when the person is overly sensitive to certain frequency ranges of sound. This can result in pain, anxiety, annoyance, stress, and intolerance resulting from sounds within the problematic frequency range.

Current treatments for APD or ASOR are limited and ineffective. Physical devices, such as sound blocking earplugs, can reduce noise intensity. Many patients with ASOR wear soft ear plugs inside their ear canals or large protective ear muffs or headphones. While these solutions block noises that are distracting or uncomfortable to the patient, they also block out important and/or necessary sounds such as normal conversation or instructions from teachers or parents.

For some individuals with APD or ASOR, therapy such as occupational therapy or auditory training is sometimes recommended. These programs or treatments can train an individual to identify and focus on stimuli of interest and to manage unwanted stimulus. Although some positive results have been reported using therapy or training, its success has been limited and APD or ASOR remains a problem for the vast majority of people treated with this approach. Additionally, therapy can be expensive and time consuming, and may require a trained counselor or mental health specialist. It may not be available everywhere.

These approaches described above are often slow, expensive, and ineffective in helping an individual, especially a child, manage environmental sounds stimuli.

Described herein are devices, systems, and methods to modify the sound coming from an individual's environment, and to allow a user to control what sound(s) is delivered to them, and how the sound is delivered.

SUMMARY OF THE DISCLOSURE

In some embodiments, an audio input device is provided, comprising a housing an instrument carried by the housing and configured to receive an input sound signal, and a processor disposed in the housing and configured to modify the input sound signal so as to amplify frequencies corresponding to a target human voice and diminish frequencies not corresponding to the target human voice.

In one embodiment, the device further comprises a speaker coupled to the processor and configured to receive the modified input sound signal from the processor and produce a modified sound to a user.

In some embodiments, the speaker is disposed in an earpiece separate from the auditory device. In other embodiments, the speaker is carried by the housing of the auditory device.

In one embodiment, the instrument comprises a microphone.

In some embodiments, the input sound signal comprises a sound wave. In other embodiments, the input sound signal comprises a digital input.

In one embodiment, the device further comprises a user interface feature configured to control the modification of the input signal by the processor. In some embodiments, adjustment of the user interface feature can cause the processor to modify the input signal to decrease an intensity of frequencies corresponding to the target human voice. In other embodiments, adjustment of the user interface feature can cause the processor to modify the input signal to increase an intensity of frequencies corresponding to the target human voice.

A method of treating an auditory disorder is also provided, comprising receiving an input sound signal with an audio input device, modifying the input sound signal with a processor of the audio input device so as to amplify frequencies corresponding to a target human voice and diminish frequencies not corresponding to the target human voice, and delivering the modified input sound signal to a user of the audio input device.

In some embodiments, the delivering step comprises delivering the modified input sound signal to the user with a speaker.

In another embodiment, the receiving step comprises receiving the input sound signal with a microphone.

In some embodiments, the input sound signal comprises a sound wave. In other embodiments, the input sound signal comprises a digital input.

In one embodiment, the method further comprises adjusting a user interface feature of the auditory device to control the modification of the input signal by the processor. In some embodiments, adjusting the user interface feature can cause the processor to modify the input signal to decrease an intensity of frequencies corresponding to the target human voice. In other embodiments, adjusting the user interface feature can cause the processor to modify the input signal to increase an intensity of frequencies corresponding to the target human voice.

A method of treating an auditory disorder of a user having an auditory gap condition is provided, comprising inputting speech into an audio input device carried by the user, identifying gaps in the speech with a processor of the audio input device, modifying the speech by extending a duration of the gaps with the processor, and outputting the modified speech to the user to from the audio input device to correct the auditory gap condition of the user.

In some embodiments, the gap condition comprises an inability of the user to properly identify gaps in speech.

In other embodiments, the outputting step comprises outputting a sound signal from an earpiece.

In some embodiments, the inputting, identifying, modifying, and outputting steps are performed in real-time. In other embodiments, the audio input device can compensate for the modified speech by playing buffered audio at a speed slightly higher than the speech.

In one embodiment, the inputting, identifying, modifying, and outputting steps are performed on demand. In another embodiment, the user can select a segment of speech for modified playback.

In some embodiments, the method comprises identifying a minimum gap duration that can be detected by the user. In one embodiment, the modifying step further comprises modifying the speech by extending a duration of the gaps with the processor to be longer than or equal to the minimum gap duration.

In one embodiment, speech comprises continuous spoken speech.

In some embodiments, the identifying step is performed by an audiologist. In other embodiments, the identifying step is performed automatically by the audio input device. In another embodiment, the identifying step is performed by the user.

A method of treating an auditory disorder of a user having a dichotic hearing condition corresponding to a delay perceived by a first ear of the user but not by a second ear of the user is provided, comprising inputting an input sound signal into first and second channels of an audio input device carried by the user, the first channel corresponding to the first ear of the user and the second channel corresponding to the second ear of the user, modifying the input sound signal in the second channel by adding a compensation delay to the input sound signal in the second channel with a processor of the audio input device, and outputting input sound signal from the first channel into the first ear of the user and outputting the modified input sound signal from the second channel into the second ear of the user from the audio input device to correct the dichotic hearing condition.

An audio input device configure to treat a user having a dichotic hearing condition corresponding to a delay perceived by a first ear of the user but not by a second ear of the user is provided, comprising at least one housing first and second microphones carried by the at least one housing and configured to receive a sound signal into first and second channels, a processor disposed in the at least one housing and configured to modify the input sound signal by adding a compensation delay to the input sound signal in the second channel, and at least one speaker carried by the at least one housing, the at least one speaker configured to output the input sound signal from the first channel into the first ear of the user and outputting the modified input sound signal from the second channel into the second ear of the user to treat the dichotic hearing condition.

In some embodiments, the at least one housing comprises a pair of earpieces configured to be inserted at least partially into the user's ears.

BRIEF DESCRIPTION OF THE DRAWINGS

The novel features of the invention are set forth with particularity in the claims that follow. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE DISCLOSURE

The disclosure describes a customizable sound modifying system. It allows a person to choose which sounds from his environment are presented to him, and at what intensity the sounds are presented. It may allow the person to change the range of sounds presented to him under different circumstances, such as when in a crowd, at school, at home, or on a bus or airplane. The system is easy to use, and may be portable and carried by the user. The system may have specific inputs to better facilitate input of important sounds, such as a speaker's voice.

The sound modifying system controls sound that is communicated to the device user. The system may allow all manner of sounds, including speech, to be communicated to the user in a clear manner. The user can use the system to control the levels of different frequencies of sound he or she experiences. The user may manually modify the intensity of different sound pitches and decibels in a way that the user can receive the surrounding environmental sounds with a reduced intensity, but still in a clear and understandable way.

The user may listen to the sounds of the environment, chose an intensity level for one or more frequencies of the sounds using the device, and lock in the intensity of particular sounds communicated by the user into the system. The system can deliver sounds to the user at the chosen intensities. In another aspect, the system may deliver sounds to the user using one or more preset intensity levels.

The sound modifying system can be used according to an individual's specifications.

Figure 1A:
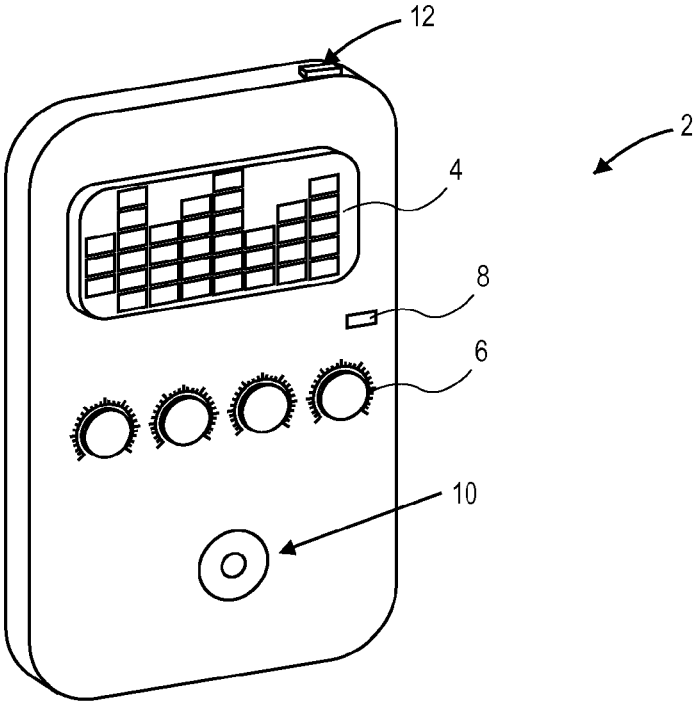
FIGS. 1A-1B are one embodiment of an audio input device.

FIG. 1A shows a front view of auditory input device 2 according to one aspect of the disclosure. When in use, the system may gather sound using an instrument 10 such as a microphone. The instrument 10 can be carried by a housing of the device and may pick up all sounds in the region of the device.

The components within the auditory input device may be configured to capture, identify, and limit the sounds and generate one or more intensity indicator(s). The intensities and the adjustable or pre-set limit of different sound frequencies may be displayed, such as on graphic display 4. In some embodiments, the sound frequencies can be displayed in the form of a bar chart or a frequency spectrum. Any method may be used to indicate sound intensity or intensity limits, including but not limited to a graph, chart, and numerical value. The graphs and/or charts may show selected frequencies, wave lengths or wave length intervals or gaps and the user adopted limits.

The user can modify the sound signal received by instrument 10 using interface feature 6. The interface feature can be, for example, a button, a physical switch, a lever, or a slider, or alternatively can be accessed with a touch screen or through software controlling the graphic display. In one embodiment the user can manually set the intensity of a specific frequency interval(s). For example, the user can use interface feature 6 to decrease or increase the intensity of a frequency of interest. The intensity of multiple intervals and limits may be set or indicated. In some embodiments, the chosen intensity levels for the frequency series may be locked using lock 8. Any form of lock may be used (e.g., button, slider, switch, etc).

Incoming sound signals can be captured by the device using instrument or microphone 10. Alternatively, or in addition, sounds from a microphone remote from the unit may be communicated to the unit. In one example, a microphone may be worn by a person who is speaking or placed near the person who is speaking. For example, a separate microphone may be placed near or removably attached to a speaker (e.g., a teacher or lecturer) or other source of sound (e.g., a speaker or musical instrument). Sounds may additionally or instead be communicated from a computer or music player of any sort. The microphone used by the auditory input device may be wired or wireless. The microphone may be a part of the auditory input device or may be separate from it.

A processor can be disposed within the auditory input device 2 and can be configured to input the signals from microphone 10, and modify the noise frequency by limiting intensity, neutralizing sound pitches, and/or inducing interfering sound frequencies to aid the user in hearing sounds in a method more conducive to his or her own sound preferences. The processor can, for example, include software or firmware loaded onto memory, the software or firmware configured to apply different algorithms to an input audio signal to modify the signal. Modified or created sound can then be transmitted from the device to the user, such as through headphone inlet 12 to a set of headphones (not shown). In other embodiments, sound may instead be transmitted wirelessly to any earpiece or speaker system able to communicate sounds or a representation of sounds to a user.

In one embodiment, the device is capable of controlling and modifying sound delivered to an individual, including analyzing an input sound, and selectively increasing or reducing the intensity of at least one frequency or frequency interval of sound. The sound intensity may be increased or reduced according to a pre-set limit or according to a user set limit. The user set sound intensity limit may include the step of the user listening to incoming sound before determining a user set sound intensity limit.

A complete system may include one or more of an auditory input device 2, a sound communication unit (e.g., an earplug, ear piece, or headphones that is placed near or inside the ear canal) and one or more microphone systems. Examples of various sound communication units are described in more detail below.

The auditory input device 2 is configured to receive one or more input signals. An input signal may be generated in any way and may be received in any way that communicates sound to the sound modifying unit. The input signal may be a sound wave (e.g., spoken language from another person, noises from the environment, music from a loudspeaker, noise from a television, etc) or may be a representation of a sound wave. The input signal may be received via a built in microphone, via an external microphone, or both or in another way. A microphone(s) may be wirelessly connected with the auditory input device or may be connected to the auditory input device with a wire. One or more input signals may be from a digital input. An input signal may come from a computer, a video player, an mp3 player, or another electronic device.

As described above, the auditory input device 2 may have a user interface feature 10 that allows a user or other person to modify the signal(s). The user interface feature may be any feature that the user can control. The user interface feature may be, for example, one or more of knobs, slider knobs, or slider or touch sensitive buttons. The slider buttons may be on an electronic visual display and may be controlled by a touch to the display with a finger, hand, or object (e.g., a stylus).

A position or condition of the user interface feature 10 may cause the auditory input device 2 to modify incoming sound. There may be a multitude of features or buttons with each button or feature able to control a particular frequency interval of sound. In some embodiments, a sound or a selected frequency of sounds may be increased or decreased in signal intensity before the sound is transferred to the user. For example, signal of interest, such as a speaker's voice, may be increased in intensity. An unwanted sound signal, such as from a noisy machine or other children, may be reduced in intensity or eliminated entirely. Sound from the device may be transferred to any portion(s) of a user's ear region (e.g., the auditory canal, or to or near the pinna (outer ear)).

The auditory input device 2 may have one or more default settings. One of the default settings may allow unchanged sound to be transmitted to the user. Other default settings may lock in specified pre-set intensity levels for one or more frequencies to enhance or diminish the intensities of particular frequencies. The default settings may be especially suitable for a particular environment (e.g., school, home, on an airplane). In one example a default setting may amplify lower frequencies corresponding to a target human voice and diminish higher frequencies not corresponding to the target human voice. The higher frequencies not corresponding to the target human voice can be, for example, background noise from other people, or noise from machinery, motor vehicles, nature, or electronics.

The auditory input device can also be tailored to treat specific Auditory Process Disorder or Auditory Sensory Over-Responsivity conditions. For example, a user can be diagnosed with a specific APD or ASOR condition (e.g., unable to clearly hear speech, unable to focus in the presence of background noise, unable to detect gaps in speech, dichotic hearing conditions, hyperacusis, etc.), and the auditory input device can be customized, either by an audiologist, by the user himself, or automatically, to treat the APD or ASOR condition.

For example, in some embodiments the auditory input device can be configured to correct APD conditions in which a user is unable to detect gaps in speech, hereby referred to as a "gap condition." First, the severity of the user's gap condition can be diagnosed, such as by an audiologist. This diagnosis can determine the severity of the gap condition, and the amount or length of gaps required by the user to clearly understand continuous speech. The auditory input device can then be configured to create or extend gaps into sound signals delivered to the user.

Figure 1B:
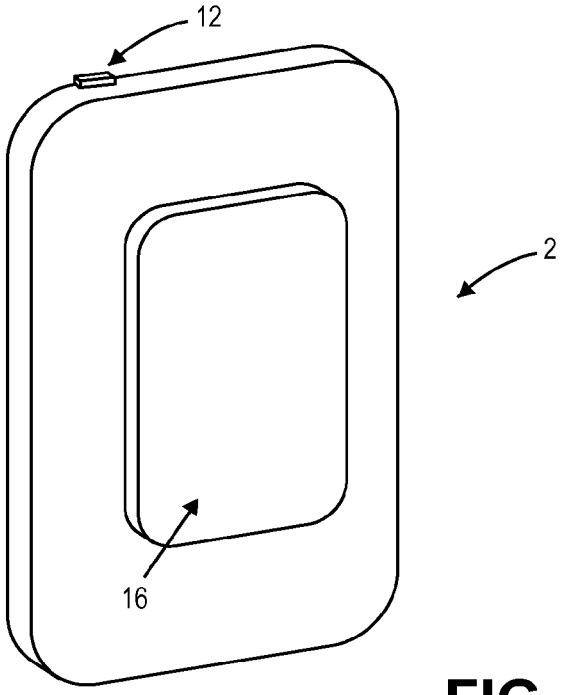
Figure 7:
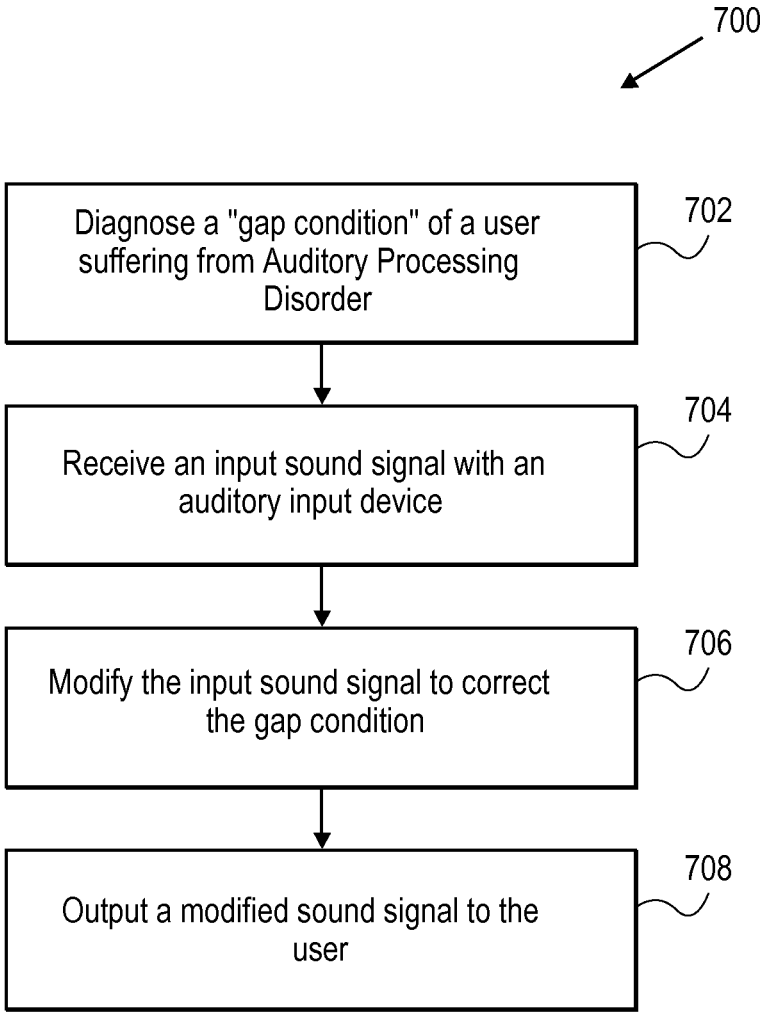
FIG. 7 is a flowchart describing one method for using an audio input device.

One embodiment of a method of correcting a gap condition with an auditory input device, such as device 2 of FIGS. 1A-1B, is described with reference to flowchart 700 of FIG. 7. First, referring to step 702 of flowchart 700, the method involves diagnosing a gap condition of a user. This can be done, for example, by an audiologist. In some embodiments, the gap condition can be self-diagnosed by a user, or automatically diagnosed by device 2 of FIGS. 1A-1B. In some embodiments, the diagnosis involves determining a minimum gap duration $G_D$ that can be detected by the user. For example, if the user is capable of understanding spoken speech with gaps between words having a duration of 7 ms, but any gaps shorter than 7 ms lead to confusion or not being able to understand the spoken speech, then the user can be said to have a minimum gap duration $G_D$ of 7 ms.

Next, referring to step 704 of flowchart 700, the method can include receiving an input sound signal with an auditory input device. The sound signal can be, for example, continuous spoken speech from a person and can be received by, for example, a microphone disposed on or in the auditory input device, as described above.

Next, referring to step 706 of flowchart 700, the method can include modifying the input sound signal to correct the gap condition. The input sound signal can be modified in a variety of ways to correct the gap condition. In one embodiment, the auditory input device can detect gaps in continuous speech, and extend the duration of the gaps upon playback to the user. For example, if a gap is detected in the received input sound signal having a duration $G_T$, and the duration $G_T$ is less than the diagnosed minimum gap duration $G_D$ described above, then the auditory input device can extend the gap duration to a value $G_{T'}$, wherein $G_{T'}$ is equal to or greater than the value of the minimum gap duration $G_D$.

In another embodiment, the gap condition can be corrected emphasizing or boosting the start of a spoken word following a gap. For example, if a gap is detected, the auditory input device can increase the intensity or volume of the first part of the word following the gap, or can adjust the pitch, frequency, or other parameters of that word so as to indicate to the user that the word follows a gap.

Method step 706 of flowchart 700 can be implemented in real-time. When the gap correction is applied in real time, the sound heard by the user will begin to lag behind the actual sound directed at the user. For example, when a person is speaking to the user, and gaps in the speech are extended and delivered to the user by the device, the user will hear the sound signals slightly after the time when the sound signals are actually spoken. The auditory input device can compensate for this by, after extending the gap, playing back buffered audio at a speed slightly higher than the original sound while maintaining the pitch of the original sound. This accelerated rate of playback can be maintained until there is no buffered sound. In another embodiment, the device can "catch up" to the original sound by shortening other gaps that are larger than $G_D$. It should be understood that the gaps that are shortened should not be shortened to a duration less than $G_D$.

In other embodiments, the gap correction can be implemented on demand at a later time as chosen by the user. For example, the auditory input device can include electronics for recording and storing sound, and the user can revisit or replay recorded sound for comprehension at a later time. In this embodiment, the gap correction can operate in the same way as described above. More specifically, the input device can identify gaps $G_T$ in speech shorter than $G_D$, and can extend the gaps to a duration $G_{T'}$ that is greater than or equal to $G_D$ to help the user understand the spoken speech. Segments of speech selected by the user can be played back at any time. In some embodiments, if a user attempts to play back a specific segment of speech more than once, the device can further increase the duration of gaps in the played back speech to help the user understand the conversation.

In some embodiments, the extended gaps are not extended with pure silence, since complete silence can be detected by a user and can lead to confusion. In some embodiments, a "comfort noise" can be produced by the device during the gap extension which is modeled on the shape and intensity of the noise detected during the original gap.

In other embodiments the auditory input device can be configured to correct ASOR conditions in which a user suffers from dichotic hearing. In particular, the device can be configured to correct a dichotic condition when sound signals heard by a user in one ear are perceived to be delayed relative to sound signals heard in the other ear. First, the severity of the user's dichotic condition can be diagnosed, such as by an audiologist. This diagnosis can determine the severity of the dichotic condition, such as the amount of delay perceived by one ear relative to the other ear. The auditory input device can then be configured to adjust the timing of how sound signals are delivered to each ear of the user.

Figure 8:
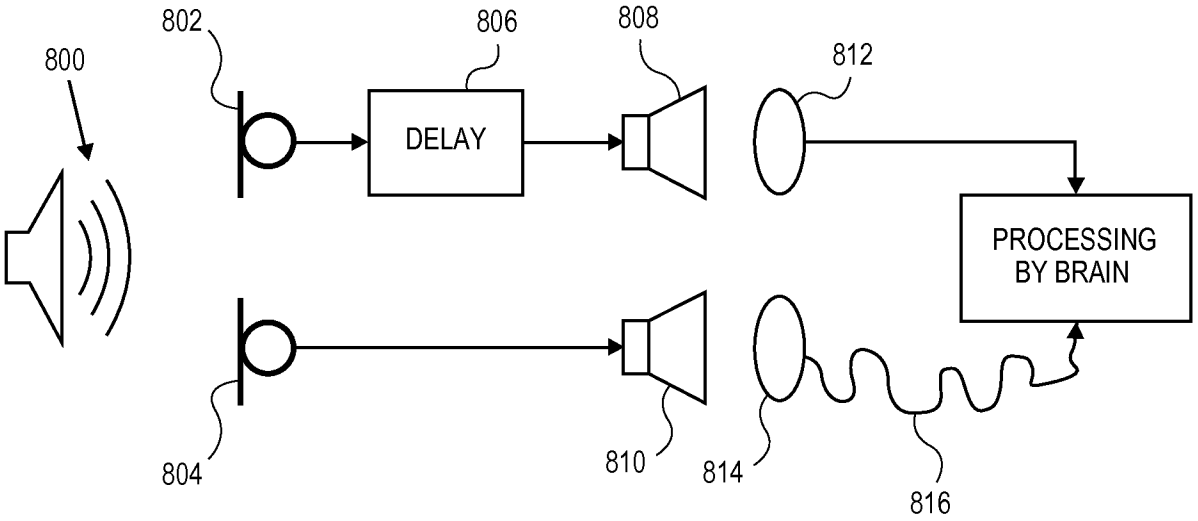
FIG. 8 is a schematic drawing describing another method of use of an audio input device.

One embodiment of a method of correcting a dichotic hearing condition with an auditory input device, such as auditory input device 2 of FIGS. 1A-1B, is described with reference to FIG. 8. FIG. 8 represents a schematic diagram of a user with a dichotic hearing condition, having a "normal" ear 812 and an "affected" ear 814. The affected ear 814 can be diagnosed as adding a delay to the sound processed from the brain by that ear. In some embodiments, the diagnosis can determine exactly how much of a delay the affected ear adds to perceived sound.

Still referring to FIG. 8, sound 800 can be received by the auditory input device in separate channels 802 and 804. This can be accomplished, for example, by receiving sound with two microphones corresponding to channels 802 and 804. The microphones can be placed on, in, or near both of the user's ears to simulate the actual location of the user's ears to received sound signals. In some embodiments, the auditory input device can be incorporated into one or both earpieces of a user to be placed in the user's ears.

The device can add a delay 806 to the channel corresponding to the "normal" ear 812. The delay can be added, for example, by the processor of the audio input device, such as by running an algorithm in software loaded on the processor. The added delay should be equal to or close to the delay diagnosed above, so that when the sound signals are delivered to ears 812 and 814, they are processed by the brain at the same time. Thus, the device can modify an input sound signal corresponding to a "normal" ear (by adding a delay) so as to compensate for a delay in the sound signal created by an "affected" ear. The result is sound signals that are perceived by the user to occur at the same time, thereby correcting intelligibility issues or any other issues caused by the user's dichotic hearing condition.

In another embodiment, a dichotic hearing condition can be treated in a different way. In this embodiment, an audio signal can be captured by one microphone or a set of microphones positioned near one of the user's ears, and that signal can then be routed to both ears of the user simultaneously. This method allows the user to focus on one set of sound (for example one unique conversation) instead of being distracted by two conversations happening simultaneously on either side of the user. Note that it is also possible to only partially attenuate the unwanted sound to allow the user to still catch events (such as a request for attention). In some embodiments, the user can select which ear he/she wants to focus on based on gestures or controls on the device. For example, the earpieces can be fitted with miniaturized accelerometers that would allow the user to direct the device to focus on one ear based on a head tilt or side movement. The gesture recognition can be implemented in such a way that the user directing the device appears to be naturally leaning towards the conversation he/she is involved with.

FIG. 1B shows a back view of auditory input device 2, such as the one shown in FIG. 1A, with clip 16 configured to attach the device to a belt or waistband of a user. Any system that can removably attach device 14 to a user may be used (e.g., a band, buckle, clip, hook, holster). The system may have a cord or other hanging mechanism configured to be placed around the user's body (e.g., neck). The system may be any size or shape that allows it to be used by a user. In one example, the unit can be sized to fit into a user's hand. In one specific embodiment, the unit may be about 3" by about 2" in size. The device may be roughly rectangular and may have square corners or may have rounded corners. The device may have indented portions or slightly raised portions configured to allow one or more fingers or thumb to grip the unit. Alternatively, the auditory input device might not have an attachment mechanism. In one example, the device may be configured to sit on a surface, such as a desk. In another example, the device may be shaped to fit into a pocket or purse.

Figure 2:
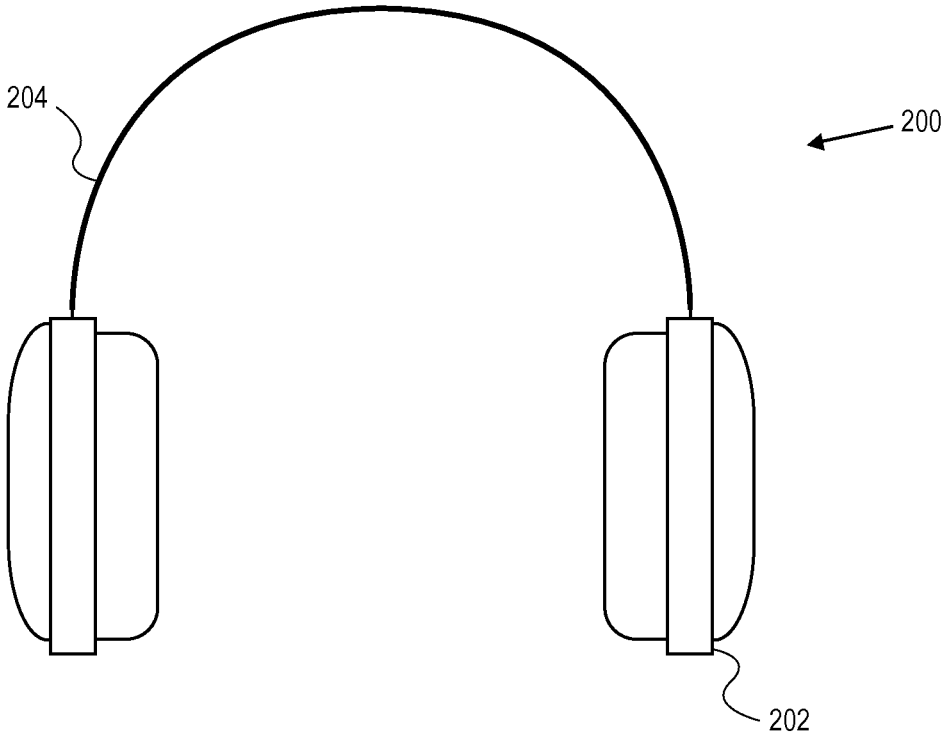
FIG. 2 shows one example of a headset for use with an audio input device.

The auditory input device may communicate with an earpiece such as the headset or earpiece 200 shown in FIG. 2. The headset can be, for example, a standard wired headset or headphones, or alternatively, can be wireless headphones. Communication between the auditory input device and the headset may be implemented in any way known in the art, such as over a wire, via WiFi or Bluetooth communications, etc. In some embodiments, the headset 200 of FIG. 2 can incorporate all the functionality of auditory input device into the headset. In this embodiment, the device (such as device 2 from FIGS. 1A-1B) is not separate from the headset, but rather is incorporated into the housing of the headset. Thus, the headset 200 can include all the components needed to input, modify, and output a sound signal, such as a microphone, processor, battery, and speaker. The components can be disposed within, for example, one of the earcups or earpieces 202, or in a headband 204.

Figure 3:
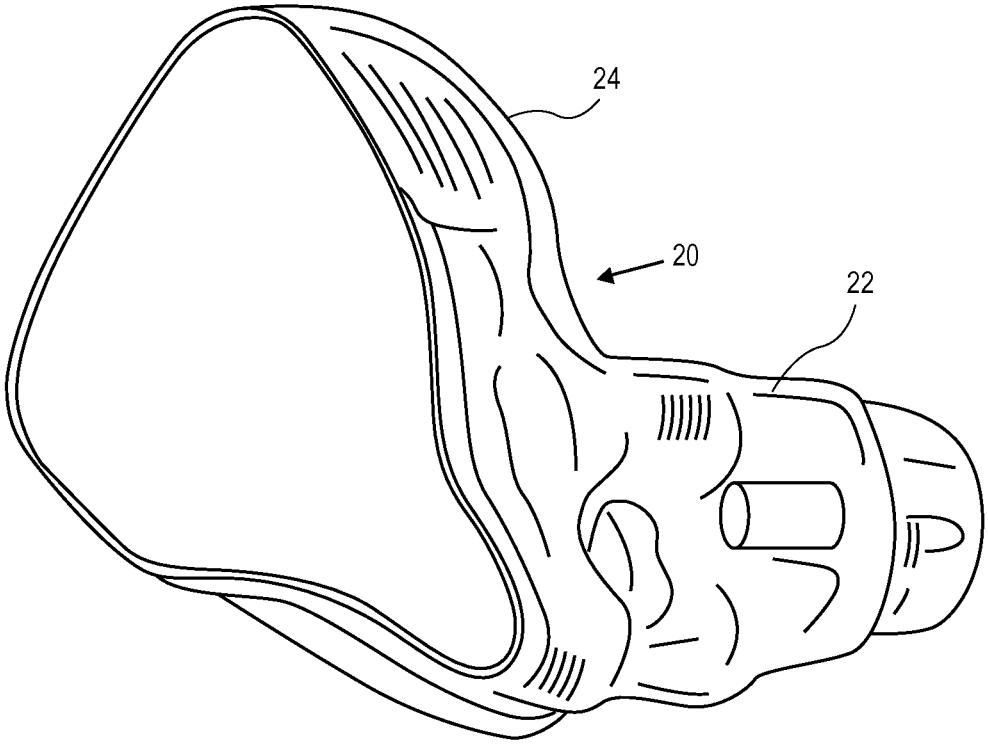
FIGS. 3-6 show embodiments of earpieces for use with an audio input device or wherein the earpiece contains the audio input device.

The earpiece may have any shape or configuration to communicate sound signals to the ear region. For example, the headset or earpiece can comprise an in-ear audio device such as earpiece 20 shown in FIG. 3. Earpiece 20 can have an earmold 22 custom molded to an individual's ear canal for exemplary fit. In some embodiments, a distal portion 24 can be shaped to block sound waves from the environment from entering the user's ear. In some embodiments, this earpiece 20 can be configured to communicate with audio input device 2 of FIGS. 1A and 1B. In other embodiments, all the components of audio input device (e.g., microphone, processor, speaker, etc) can be disposed within the earpiece 20, thereby eliminating need for a separate device in communication with the earpiece.

Figure 4:
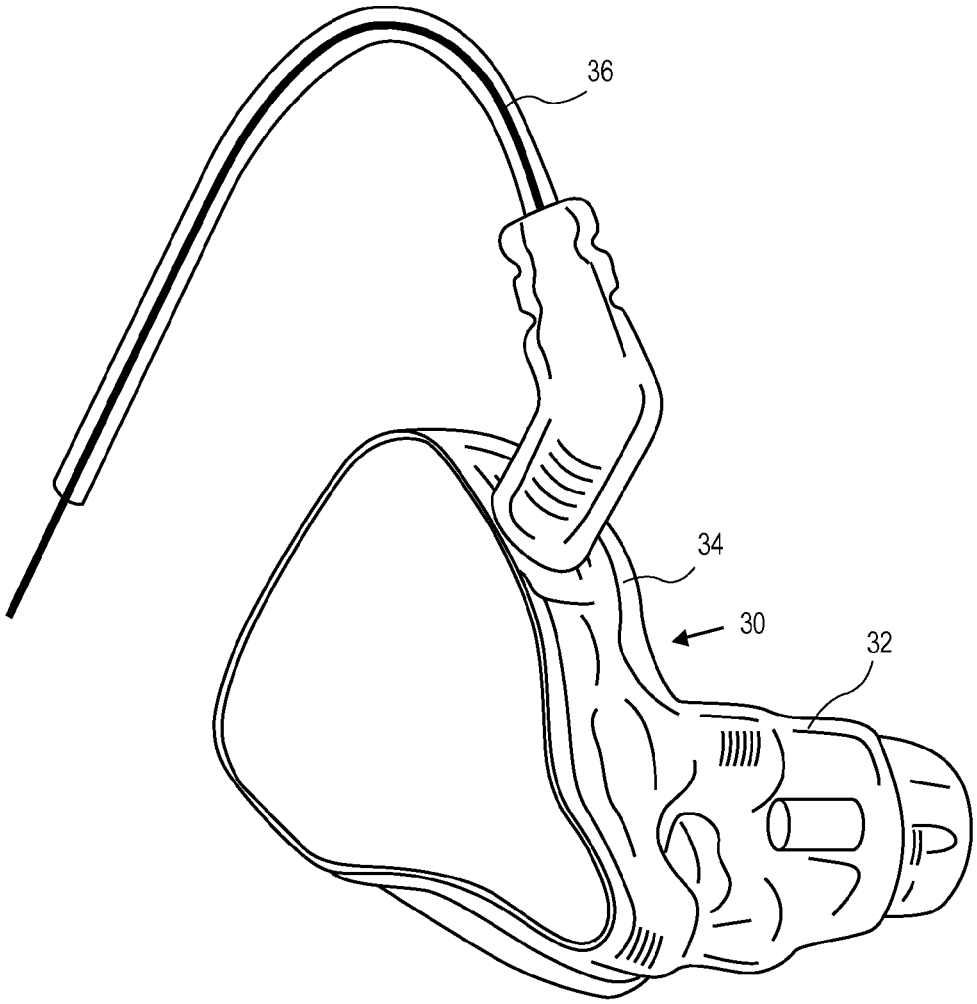

FIG. 4 shows another embodiment of an earpiece 30 configured to fit partially into an ear canal with distal portion 34 of the earpiece shaped to block sound waves from the environment from entering the user's ear. Earpiece 30 can have a receiver 36 for receiving auditory input from an audio input device, such as the device from FIGS. 1A-1B, and transmitting the auditory input to the user's ear. In another embodiment, the audio input device can be incorporated into the earpiece.

Figure 5:
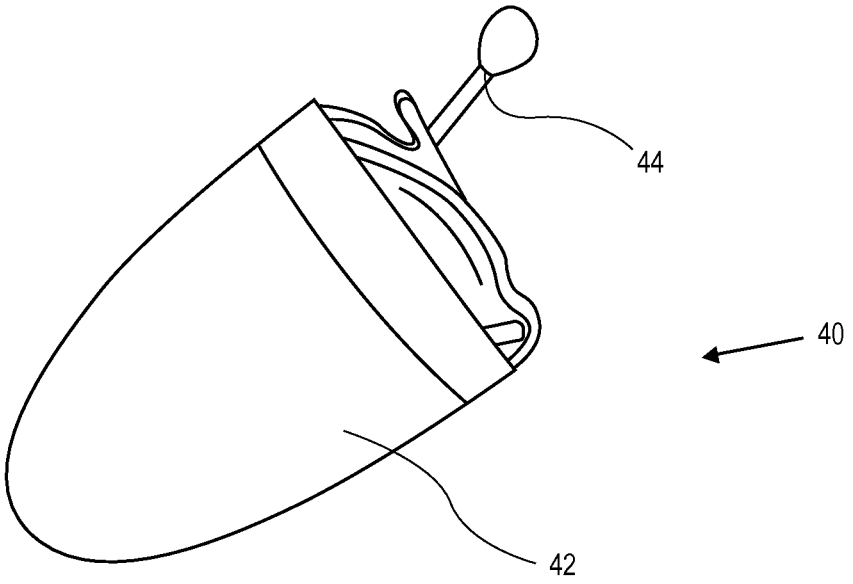

FIG. 5 shows another example of an earpiece 40, showing how some of the components of the audio input device can be incorporated into the earpiece. Microphone 44 can capture sound input signals from the environment and electronics disposed within earpiece 40 can be configured to de-intensify or modify the signals. In this example, electronics within the earpiece are responsible for modifying the signals. Earpiece 40 may de-intensify signals according to pre-set values or according to user set values. The earmold 42 may be configured to fit completely or partially in the ear canal. In one example, the earpiece may be off-the-shelf. In another example, the earmold may be custom molded. The earpiece (e.g., an earmold) may be configured to block sound except for those processed through the audio input device from entering the ear region.

In any of the auditory systems described herein, the earpiece may be configured to fit at least partially around the ear, at least partially over an ear, near the ear, or at least partially within the ear or ear canal. In one example, the earpiece can be configured to wrap at least partially around an ear. The earpiece may include a decibel/volume controller to control overall volume or a specific sound intensity of specific frequency ranges.

Figure 6:
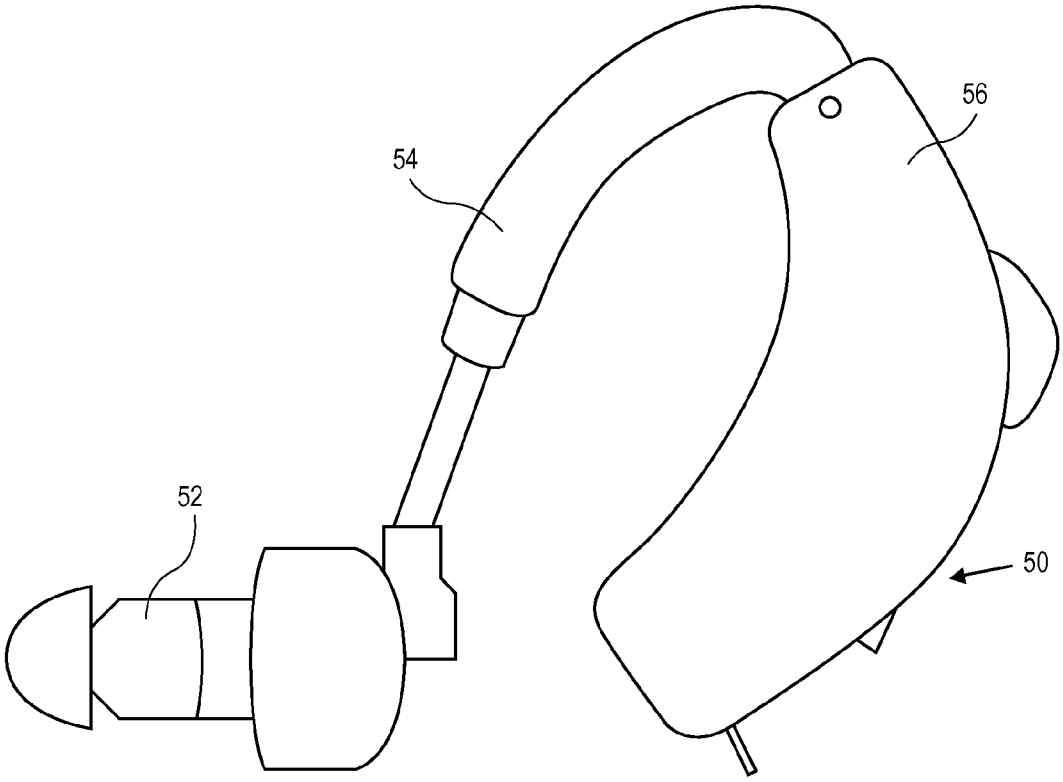

As described above, the audio input device may itself be an earpiece or part of an earpiece. FIG. 6 shows another example of an earpiece 50 with earmold 52 configured to fit into an ear canal. Earmold 52 is operably connected by earhook 54 with controller 56. In this example, the controller 56 may be configured to fit behind the ear. Controller 56 may have a microphone to collect sound and may be able to capture, identify, and limit the sounds and generate one or more intensity indicators, similar to the device described in FIGS. 1A-B. In one example, controller 56 may have preset intensity values and may control and communicate sounds from the microphone at preset intensity levels to earmold 52.

Any of the earpieces can have custom ear molds to fit the individual's ear. The earpieces may be partially custom fit and partially off-the-shelf depending on the user's needs and costs. The system may have any combination of features and parts that allows the system to detect and modify an input sound signal and to generate a modified or created output signal.

The audible frequency of hearing is generally from about 20 Hz to about 20 KHz. Human voices fall in the lower end of that range. A bass voice may be as low as 85 Hz. A child's voice may be in the 350-400 Hz range. The device may be used to ensure that a particular frequency or voice, such as a teacher's voice, is stronger. The device may be used to reduce or eliminate a particular frequency or voice, such as another child's voice or the sounds of a machine.

The systems described herein may include any one or combination of a microphone(s), a (sound) signal detector(s), a signal transducer(s) (e.g., input, output), a filter(s) including an adaptive and a digital filter(s), a detection unit(s), a processor, an adder, a display unit(s), a sound synthesize unit(s), an amplifier(s), and a speaker(s).

The systems described herein may control input sound levels sent to the ear in any way. The system may transduce sound into a digital signal. The system may apply specific filters and separate sounds into frequency ranges (wavelengths) within an overall frequency interval. The system may add or subtract portions of the sound signal input to generate modified sound signals. The system may generate a sound wave(s) or other interference that interferes with a signal and thereby reduces its intensity. The system may add or otherwise amplify a sound wave(s) to increase its intensity.

The system may transmit all or a portion of a sound frequency interval as an output signal.

In another embodiment, the system may generate sounds including a human voice(s) using a sound synthesizer (e.g., an electronic synthesizer). The synthesizer may produce a wide range of sounds, and may change an input sound, creating pitch or timbre. Any sound synthesis technique or algorithm may be used including, but not limited to additive synthesis, frequency modulation synthesis, granular synthesis, phase distortion synthesis, physical modeling synthesis, sample based synthesis, subharmonic synthesis, subtractive synthesis, and wavetable synthesis. In other embodiments, the auditory input device can be configured to produce comfort noise on demand or automatically. The comfort noise can be pink noise that can have a calming effect on patients that have problems with absolute silence.

In one example, the system may identify a certain sound(s) by detecting a particular frequency of sound. The system may transduce the sound into an electrical signal, detect the signal(s) with a digital detection unit, and display the signal for the user. The process may be repeated for different frequencies or over a period of time.

As for additional details pertinent to the present invention, materials and manufacturing techniques may be employed as within the level of those with skill in the relevant art. The same may hold true with respect to method-based aspects of the invention in terms of additional acts commonly or logically employed. Also, it is contemplated that any optional feature of the inventive variations described may be set forth and claimed independently, or in combination with any one or more of the features described herein. Likewise, reference to a singular item, includes the possibility that there are plural of the same items present. More specifically, as used herein and in the appended claims, the singular forms "a," "and," "said," and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation. Unless defined otherwise herein, all technical and scientific terms used herein have the same meaning as commonly understood by one of ordinary skill in the art to which this invention belongs. The breadth of the present invention is not to be limited by the subject specification, but rather only by the plain meaning of the claim terms employed.

What is claimed is:

1. A method of treating an auditory disorder of a user having a dichotic hearing condition corresponding to a delay perceived by a first ear of the user but not by a second ear of the user, comprising:

inputting an input sound signal into first and second channels of an audio input device carried by the user, the first channel corresponding to the first ear of the user and the second channel corresponding to the second ear of the user;

modifying the input sound signal in the second channel by adding a compensation delay to the input sound signal in the second channel with a processor of the audio input device; and outputting input sound signal from the first channel into the first ear of the user and outputting the modified input sound signal from the second channel into the second ear of the user from the audio input device to correct the dichotic hearing condition.

2. The method of claim 1 wherein the input sound signal comprises a sound wave.

3. The method of claim 1 wherein the input sound signal comprises a digital input.

4. An audio input device configure to treat a user having a dichotic hearing condition corresponding to a delay perceived by a first ear of the user but not by a second ear of the user, comprising;

at least one housing;

first and second microphones carried by the at least one housing and configured to receive a sound signal into first and second channels;

a processor disposed in the at least one housing and configured to modify the input sound signal by adding a compensation delay to the input sound signal in the second channel; and at least one speaker carried by the at least one housing, the at least one speaker configured to output the input sound signal from the first channel into the first ear of the user and outputting the modified input sound signal from the second channel into the second ear of the user to treat the dichotic hearing condition.

5. The audio input device of claim 4 wherein the at least one housing comprises a pair of earpieces configured to be inserted at least partially into the user's ears.

6. The audio input device of claim 4 wherein the sound signal comprises a sound wave.

7. The audio input device of claim 4 wherein the sound signal comprises a digital input.

8. The audio input device of claim 4 further comprising a user interface feature configured to control a modification of the sound signal by the processor.

9. The audio input device of claim 8 wherein adjustment of the user interface feature can cause the processor to modify the sound signal to decrease an intensity of frequencies corresponding to a target human voice.

10. The audio input device of claim 8 wherein adjustment of the user interface feature can cause the processor to modify the sound signal to increase an intensity of frequencies corresponding to a target human voice.

* * * * *